US010986919B2

(12) United States Patent
Knapp et al.

(10) Patent No.: US 10,986,919 B2
(45) Date of Patent: Apr. 27, 2021

(54) DESK STABILIZER BAR

(71) Applicant: CKnapp Sales, Inc., Goodfield, IL (US)

(72) Inventors: Chance Knapp, Goodfield, IL (US); Brandon Meyer, Normal, IL (US)

(73) Assignee: CKnapp Sales, Inc., Goodfield, IL (US)

( * ) Notice: Subject to any disclaimer, the term of this patent is extended or adjusted under 35 U.S.C. 154(b) by 36 days.

(21) Appl. No.: 16/279,267

(22) Filed: Feb. 19, 2019

(65) Prior Publication Data

US 2020/0260862 A1 Aug. 20, 2020

(51) Int. Cl.

| | |
|---|---|
| ***A47B 13/06*** | (2006.01) |
| ***A47B 21/03*** | (2006.01) |
| *A47B 13/02* | (2006.01) |

(52) U.S. Cl.

CPC ..... *A47B 13/06* (2013.01); *A47B 21/03* (2013.01); *A47B 2013/028* (2013.01); *A47B 2200/0012* (2013.01); *A47B 2200/0015* (2013.01); *A47B 2200/0016* (2013.01)

(58) Field of Classification Search

CPC . A47B 13/06; A47B 21/03; A47B 2200/0012; A47B 2013/028; A47B 2200/0015; A47B 2200/0016

USPC ..... 248/200.1, 231.41, 323

See application file for complete search history.

(56) References Cited

U.S. PATENT DOCUMENTS

| | | | | |
|---|---|---|---|---|
| 2,592,839 A * | 4/1952 | Wessig | A47B 3/0818 108/133 |
| 5,346,036 A * | 9/1994 | Arisman | A62B 35/04 182/3 |
| 6,591,574 B2 * | 7/2003 | Humphrey | E04G 13/00 248/200.1 |
| 2008/0237431 A1 * | 10/2008 | Tarr | A63H 19/34 248/440 |
| 2013/0305964 A1 * | 11/2013 | Swallow | A47B 97/00 108/42 |
| 2014/0014797 A1 * | 1/2014 | McSherry | F16B 2/12 248/231.41 |

(Continued)

OTHER PUBLICATIONS

"StandDesk Stabilizing Crossbar," retrieved from https://www.standdesk.co/standdesk-stabilizing-crossbar/, on Mar. 5, 2019, 5 pages.

(Continued)

*Primary Examiner* — Muhammad Ijaz
(74) *Attorney, Agent, or Firm* — Hanley, Flight and Zimmerman, LLC

(57) ABSTRACT

Example composite material devices, apparatus, articles of manufacture, and methods of manufacture are disclosed. An example adjustable stabilizer bar includes: a first segment having a first end and a second end; a second segment having a first end and a second end, the first end of the second segment to at least partially overlap the second end of the first segment; an attachment mechanism to position the second segment with respect to the first segment; a first clamping portion at the first end of the first segment to removably affix the first segment to a first furniture element; and a second clamping portion at the second end of the second segment to removably affix the second segment to a second furniture element.

18 Claims, 12 Drawing Sheets

(56) References Cited

U.S. PATENT DOCUMENTS

| | | | | |
|---|---|---|---|---|
| 2015/0096179 | A1* | 4/2015 | Courtney | E05B 17/06 33/194 |
| 2015/0335940 | A1* | 11/2015 | Johnson | A63B 21/40 248/118 |
| 2017/0127821 | A1* | 5/2017 | Carter | A47B 21/02 |
| 2020/0260862 | A1* | 8/2020 | Knapp | A47B 21/03 |

OTHER PUBLICATIONS

VIVO, "VIVO Black Manual Height Adjustable Sit-Stand Desk with 55" x 24" Tabletop | Standing Desk Frame and Desktop Workstation (DESK-V100M)," retrieved from https://www.amazon.com/VIVO-Adjustable-Sit-Stand-Workstation-DESK-V100M/dp/B01ITHJMBI/, on Feb. 18, 2019, 8 pages.

* cited by examiner

DESK STABILIZER BAR

BACKGROUND

The statements in this section merely provide background information related to the disclosure and may not constitute prior art.

Standing and/or other height-adjustable desks enable users to write and/or while standing, sitting on a stool, etc. Standing desks can be adjustable to suit particular environments, tasks, etc. For example, legs of the standing desk can be adjustable to accommodate a particular table height, person's height, etc. Use of a standing and/or height-adjustable desk can provide ergonomic and/or other health benefit to the user.

A standing and/or other height-adjustable desk can mount and/or otherwise be positioned with respect to other furniture, such as a regular desk, table, chair, etc. For example, the desk can be set on, bolted to, and/or otherwise be positioned on top of another piece of furniture such as a sitting desk, table, etc., to convert a sitting desk or table to a standing desk. Other standing desks are freestanding and provide an adjustable height to enable a person to stand, rather than sit, and utilize the desk surface.

Standing desks offer many health benefits to users beyond typical sitting desks. Studies show that sitting for too long is harmful to a person's health and can be a contributing factor in developing diabetes, cancer, high cholesterol, blood clots, heart problems, and other harmful health conditions. More and more people, however, have school work, jobs, and other activities that require them to sit at a desk in front of a computer. A standing and/or other height-adjustable desk allows a user to stand, rather than sit, and still utilize the desk's surface for a laptop, tablet, paperwork, etc.

Standing and/or other height-adjustable desks, however, suffer from wobbling and/or other instability, which can impair a user's ability to reliably, comfortably use the desk. Particularly at taller height settings, the desk can be too unstable for use.

Figure 1:
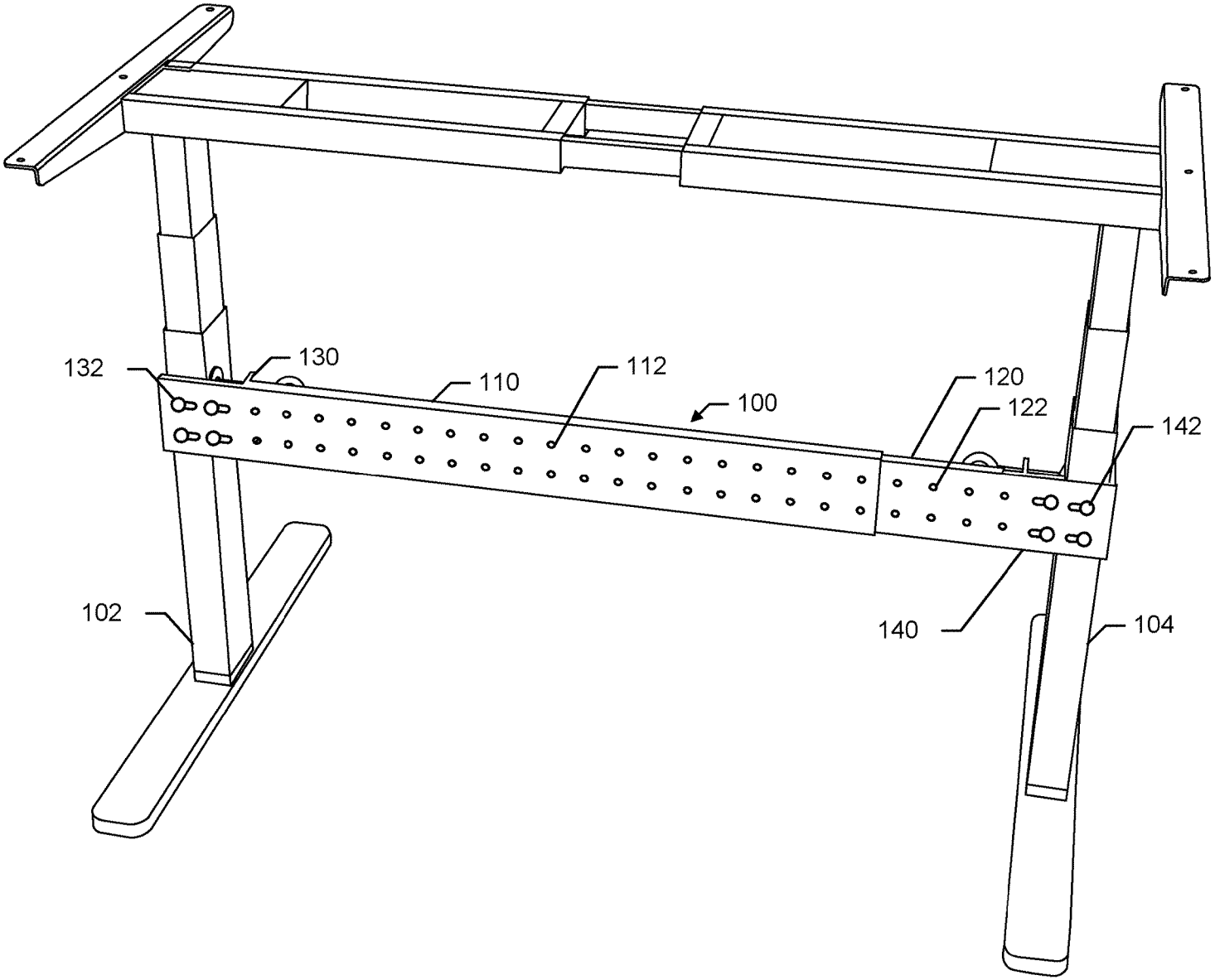
FIGS. 1-2 illustrate an example stabilizer bar.

The figures are not to scale. Instead, the thickness of the layers or regions may be enlarged in the drawings. In general, the same reference numbers will be used throughout the drawing(s) and accompanying written description to refer to the same or like parts. As used in this patent, stating that any part (e.g., a layer, film, area, region, or plate) is in any way on (e.g., positioned on, located on, disposed on, or formed on, etc.) another part, indicates that the referenced part is either in contact with the other part, or that the referenced part is above the other part with one or more intermediate part(s) located therebetween. Stating that any part is in contact with another part means that there is no intermediate part between the two parts. Although the figures show layers and regions with clean lines and boundaries, some or all of these lines and/or boundaries may be idealized. In reality, the boundaries and/or lines may be unobservable, blended, and/or irregular.

Descriptors "first," "second," "third," etc. are used herein when identifying multiple elements or components which may be referred to separately. Unless otherwise specified or understood based on their context of use, such descriptors are not intended to impute any meaning of priority or ordering in time but merely as labels for referring to multiple elements or components separately for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for ease of referencing multiple elements or components.

DETAILED DESCRIPTION

In the following detailed description, reference is made to the accompanying drawings that form a part hereof, and in which is shown by way of illustration specific examples that may be practiced. These examples are described in sufficient detail to enable one skilled in the art to practice the subject matter, and it is to be understood that other examples may be utilized and that logical, mechanical, electrical and/or other changes may be made without departing from the scope of the subject matter of this disclosure. The following detailed description is, therefore, provided to describe example implementations and not to be taken as limiting on the scope of the subject matter described in this disclosure. Certain features from different aspects of the following description may be combined to form yet new aspects of the subject matter discussed below.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements.

Certain examples provide an adjustable clamp-on desk and/or table stabilizer. Certain examples provide a stabilizer bar designed to clamp on to a furniture element such as the legs of a desk or table. The bar is adjustable in length to fit many different desk sizes by adjusting to fit the width of the desk's legs. At each end of the bar is an adjustable clamp that tightens to each leg of the desk to secure the stabilizer to the desk legs.

A large number of height adjustable desks currently available do not include a stabilizer bar. As a result, such desks become increasingly unstable as they are raised. That is, an adjustable desk's best stability is found when the desk is in its lowest position, unsuitable for most users. As the height of the desk is raised, instability increases, often in proportion to height, as the weight of the desk and the size of the legs create a tendency for movement, particularly when interacted with by a user.

In addition, currently available stabilizer bars must be either bolted in place or attached using another device such as hooks, requiring the legs of the desk to include provisions for mounting these stabilizers. Unfortunately, the majority of height adjustable desks that do not include stabilizer bars also do not include provisions for mounting currently available stabilizer designs. A stabilizer bar with a mounting design not dependent on these mounting provisions is needed to improve the stability of these desks, and the stabilizer's mounting system must be sturdy enough to firmly secure to the desk while providing the intended function.

Certain examples provide a stabilizer which, by using clamps combined with a telescopic design, is able to fit a majority of ergonomic floor standing height adjustable desks currently available. By attaching this product to the legs of the desk, the instability often found in these desks is greatly reduced, allowing for safer and more comfortable usage of the desk. In addition, installation of the stabilizer is quick and simple, requiring no modification to the desk.

A main stabilizer bar can be constructed using formed metal plates, by using a metal bar inserted into metal tubing, or by using metal tubing inserted into metal tubing of a larger size, for example. In certain examples, the stabilizer bar is telescopic, allowing it to extend to different lengths to fit desks and tables of many different sizes. The length of the stabilizer bar can be secured by inserting bolts into a series of aligned holes placed along the length of the stabilizer bar, or by inserting bolts, screws, pins, etc., into a series of aligned slots placed along the length of the stabilizer bar, etc. A clamp is attached to each end of the stabilizer bar, allowing the stabilizer to clamp onto the legs of the desk or table. The clamp can have a single clamp bolt design or a multiple clamp bolt design. The clamp can be attached to the stabilizer bar using a series of bolts inserted through aligned holes in the clamp and stabilizer bar, through slots in the stabilizer bar aligned with holes in the clamp, or by welding directly to the stabilizer bar, for example.

FIG. 1 illustrates an example stabilizer bar 100 positioned with respect to first and second furniture elements, such as legs 102, 104 of a desk or table, etc. The example stabilizer bar 100 includes a first segment 110 and a second segment 120. Each segment/portion 110, 120 includes a plurality of openings or holes to allow the first segment 110 and second segment 120 to be adjusted with respect to each other. Thus, a length of the stabilizer bar 100 can be adjusted based on an overlap of the first segment/portion 110 and the second segment/portion 120. A screw, rod, bolt, pin, clamp, etc., can be used to secure a position of the first segment 110 with respect to the second segment 120, or vice versa, to set the length of the stabilizer bar 100, which may be adjustable to accommodate different desk sizes/spacing between legs 102, 104, for example. Thus, the stabilizer bar 100 can be adjustable to fit a variety of desk/table sizes, for example.

Additionally, each end of the stabilizer bar 100 includes a clamp or mounting portion 130, 140 attached to the bar 100 via one or more screws, bolts, etc. 132, 142. The clamp/mounting 130, 140 allows the bar 100 to attach to the legs 102, 104. The clamp 130, 140 allows the bar 100 to be a "universal" clamp-on stabilizer bar 100 to adjustably clamp on to a variety of height-adjustable desks at various lengths and/or heights with respect to the legs 102, 104, for example. Placement of the bar 100 can vary to provide desired stability, such as placing the bar 100 in the center or lower of the legs 102, 104 because the desk top is holding the top of the legs 102, 104 at a specific distance, and the bar 100 locks the middle or lower middle of the legs 102, 104 at a defined distance as well (e.g., the same as the top distance or another distance depending an angle, slope, taper, etc., of the legs 102, 104), for example.

If a desk is raised to a certain height, the desk and anything on the desk (e.g., a monitor, keyboard, etc.) will shake when a user is typing, moving a mouse, and/or otherwise interacting with items on the desk, for example. The stabilizer bar 100 helps to prevent the legs 102, 104 from being able to move so that user interaction with items on the desk does not shake the desk or items on the desk.

To provide strength in support, as well as ease of installation, movable bolts and/or other clamp device(s) can be used to removably affix the bar 100 between the legs 102, 104 of an adjustable desk. In certain examples, padding can be added to the clamp 130, 140 (e.g., a soft thin foam or other material of a few millimeter thickness, etc.) to help prevent scratches or other damage. In certain examples, the clamping portion 130, 140 includes two bolts in the clamp 130, 140 for stability (e.g., 1.5 inch clamps, etc.). In other examples, a larger bolt allows for one to support the clamp 130, 140 (e.g., to provide 3-4 inches of surface pressure in one or more bolts to help ensure the leg 102, 104 does not move, etc.).

In certain examples, the stabilizer bar 100 is a telescoping bar 100 including holes or openings 112, 122 spaced apart (e.g., approximately every 2 inches, etc.). As shown in the example of FIG. 1, the bar segment 120 fits inside larger part 110 to slide in and out and then lock in place at a desired distance with bolts, screws, pins, etc. Thus, the bar 100 adjusts at a spacing interval (e.g., 1 inch, 2 inches, 3 inches, etc.), and the end clamps 130, 140 can adjust an additional distance (e.g., up to 2 inches, up to 3 inches, up to 4 inches, etc.) to allow fine adjustments to bar 100 length between the legs 102, 104 (e.g., to set a bar 100 length with segments 110, 120 and then adjust the clamps 130, 140 for an exact fit between the legs 102, 104 such as by a few millimeters adjustment, a few inches adjustment, etc.). In certain examples, the stabilizer bar 100 (e.g., its segments or portions 110, 120, etc.) is formed from cold roll steel (e.g., sheet metal, etc.), aluminum, etc.

Figure 2:
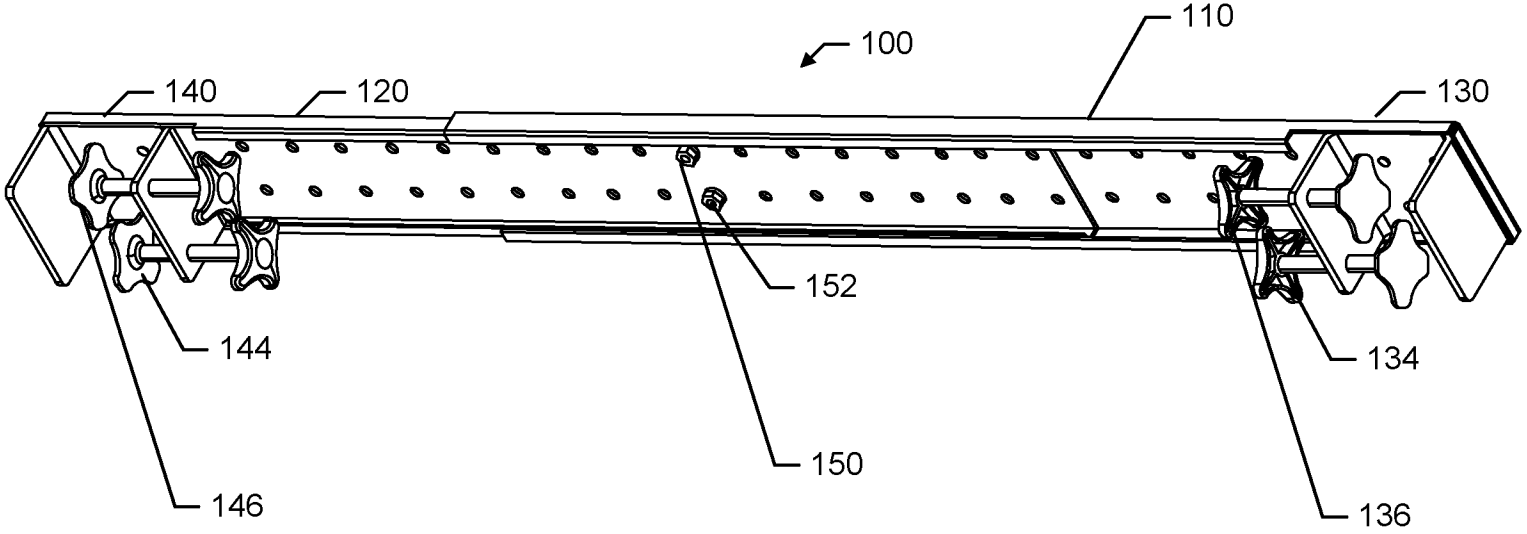

FIG. 2 depicts the example stabilizer bar 100 in space without showing its attachment to the legs 102, 104. As shown in the example of FIG. 2, the clamp portion 130, 140 includes a plurality of bolts 134, 136, 144, 146 to position the bar 100 with respect to object such as the legs 102, 104, etc. The bolts 134-136, 144-146 are movable (e.g., twistable, screwable, pushable, pullable, etc.) to allow adjustment depending on the size of the legs 102, 104 and/or other object to which the bar 100 is being removably attached. As shown in the example back or rear view of FIG. 2, the portions 110, 120 of the stabilizer bar 100 can be affixed with one or more screws, bolts, rivets, etc., 150, 152 to set a desired length for the bar 100. The bolts 134-136, 144-146 of the clamp portions 130, 140 can be used to fine-tune positioning of the bar 100 with respect to the legs 102, 104, for example.

Figure 3:
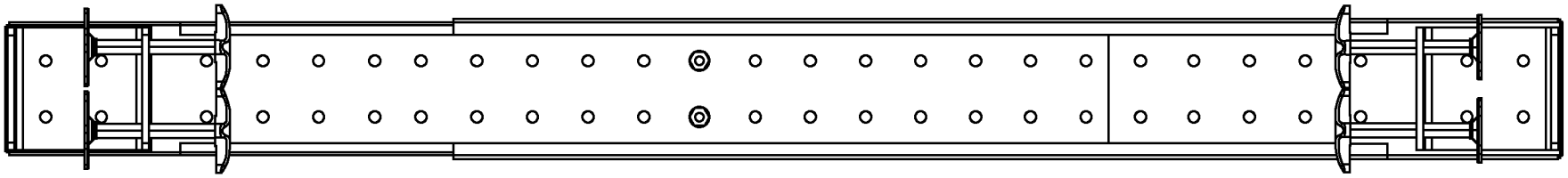
FIGS. 3-8 provide additional views of the stabilizer bar of FIGS. 1-2.
Figure 4:
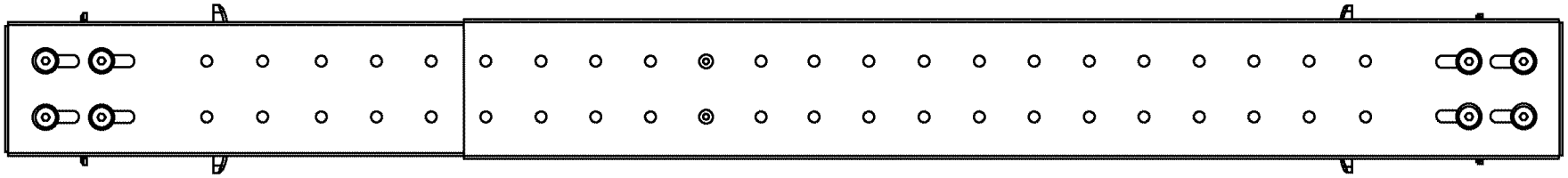
Figure 5:
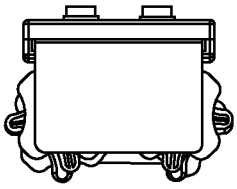
Figure 6:
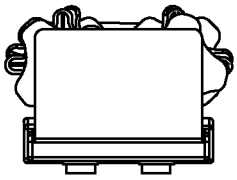
Figure 7:
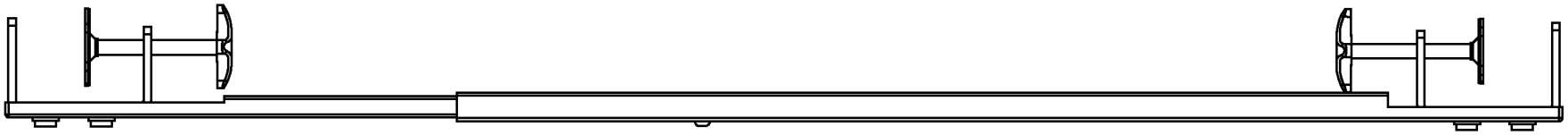
Figure 8:
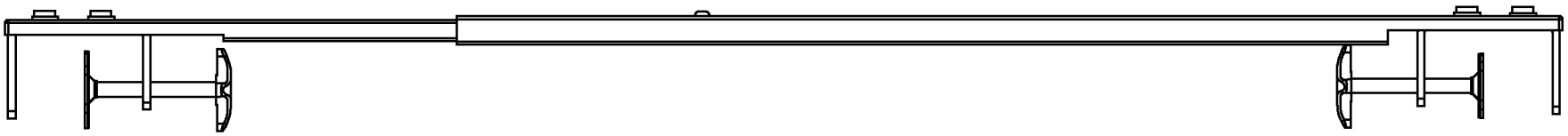

FIGS. 3-8 provide additional views of the stabilizer bar 100 shown and described with respect to FIGS. 1-2. For example, FIG. 3 provides an example back or inside view of the bar such as shown in the example of FIG. 2. FIG. 4 provides an example front or outside view of the bar 100 such as shown in the example of FIG. 1. FIGS. 5-6 show example end views of the stabilizer bar 100. FIGS. 7-8 show example side views of the stabilizer bar 100.

Figure 9:
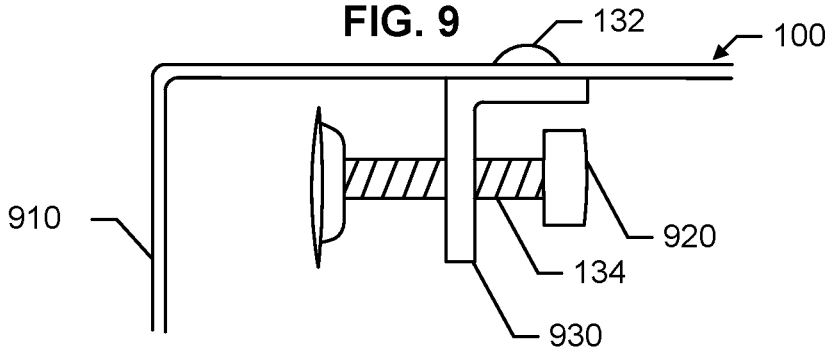
FIGS. 9-18 illustrate various clamping configurations of the stabilizer bar of FIGS. 1-8.

FIG. 9 illustrates an example configuration for the stabilizer clamp 130, 140. In the example of FIG. 9, an end 910 of the stabilizer bar 100 is bent 90 degrees forward to create half of the clamp 910. The other half of the clamp, including an adjustable clamp bolt 134 and a plate 920, is attached to the stabilizer bar 100 via a segment 930. Using the bolt 134 and the plate 920, positioning of the clamp 130, 140 with respect to the leg 102, 104 can be adjusted (e.g., fine-tuned, etc.) after the stabilizer bar 100 has been positioned between the legs 102, 104. Thus, an exact fit supporting the legs 102, 104 can be achieved with the stabilizer 100 via the clamping mechanism 130, 140 such as shown in the example of FIG. 9.

Figure 10:
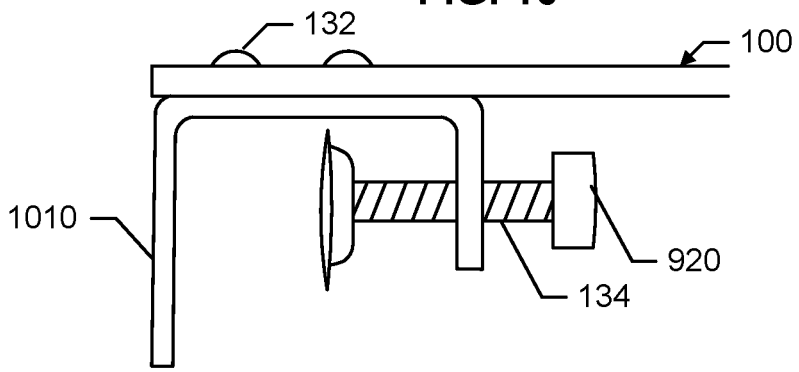

FIG. 10 shows another example configuration for the stabilizer clamp 130, 140. In the example of FIG. 10, the clamp 130, 140 is formed from a U-shaped piece 1010 attached to the stabilizer bar 100. The clamp bolt 134 and the plate 920 connect to the U-shaped segment 1010. The U-shaped piece 1010 can be constructed of a single formed piece or by assembling a series of piece designed to fit together, for example. Movement of the bolt 134 and plate 920 can position and removably secure the bar 100 with respect to a leg 102, 104, for example.

Figure 11:
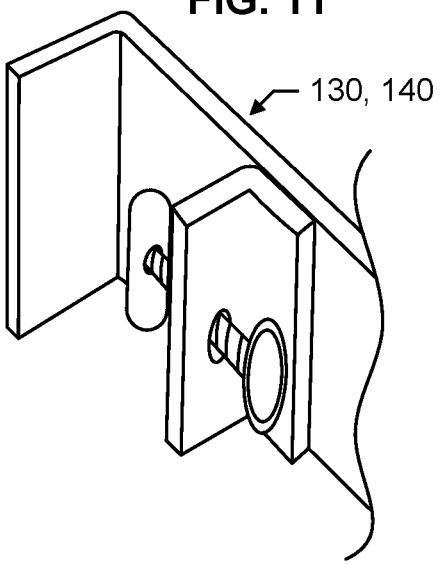

FIG. 11 depicts an example view of an end clamp 130, 140 using a single clamp bolt design. The clamp bolt 134, 136, 144, 146 secures the stabilizer 100 to the leg 102, 104, while the other side of the clamp 130, 140 provides stabilization to the leg 102, 104.

Figure 12:
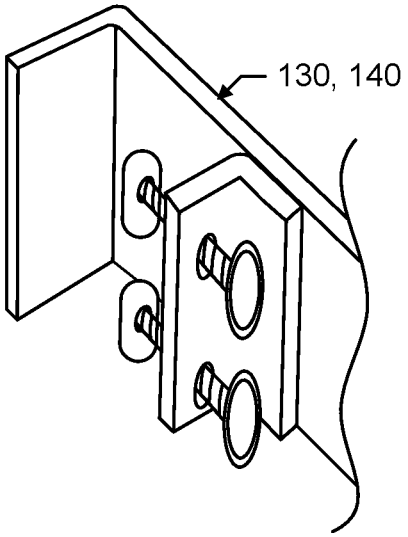

FIG. 12 shows an example view of an end clamp 130, 140 using a multiple clamp bolt design. The clamp bolts 134, 136, 144, 146 secure the stabilizer 100 to the leg 102, 104 while providing stabilization to the leg 102, 104 in addition to the other side of the clamp 130, 140.

Figure 13:
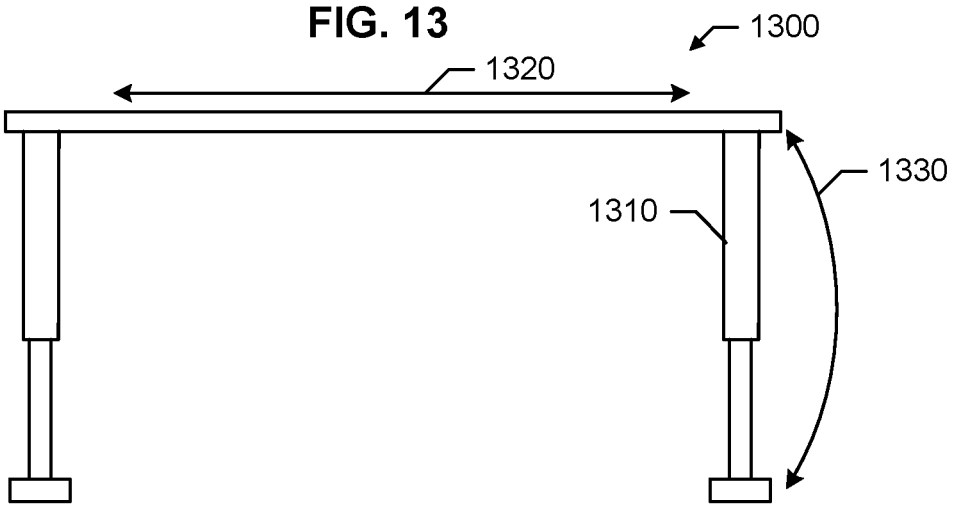
Figure 14:
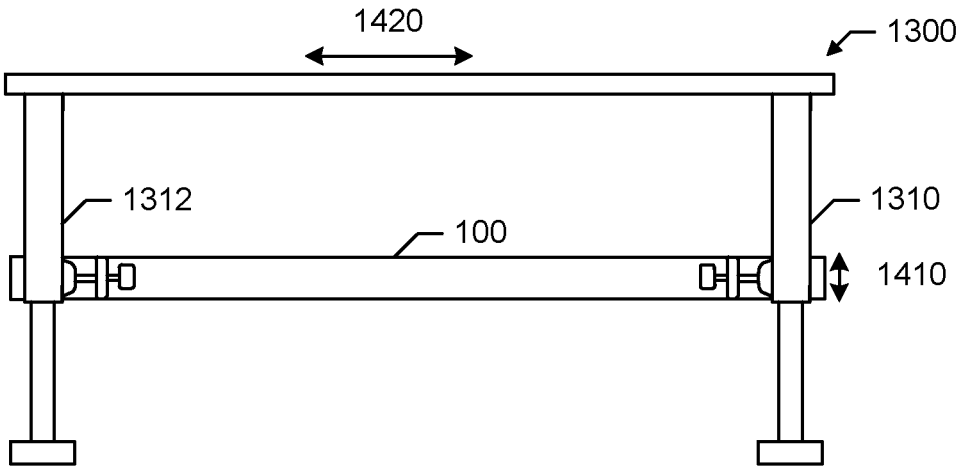

Thus, a variety of clamping mechanisms 130, 140 can enable the stabilizer bar 100 to be adaptively configured and positioned to secure the legs 102, 104 of a standing and/or other adjustable height desk, table, etc. FIG. 13 illustrates an example height adjustable desk frame 1300 without the stabilizer bar 100. A leg 1310 of the desk 1300 is secured only at the top, allowing significant horizontal motion 1320 due to a possible twisting or swinging motion 1330 of the leg 1310. In contrast, FIG. 14 shows the example height adjustable desk 1300 with the stabilizer 100 between the legs 1310, 1312. The stabilizer 100 greatly reduces the twisting or swinging motion 1410 of the leg 1310 (and of the leg 1312), thereby reducing the horizontal motion 1420 of the desk 1300.

Figure 15:
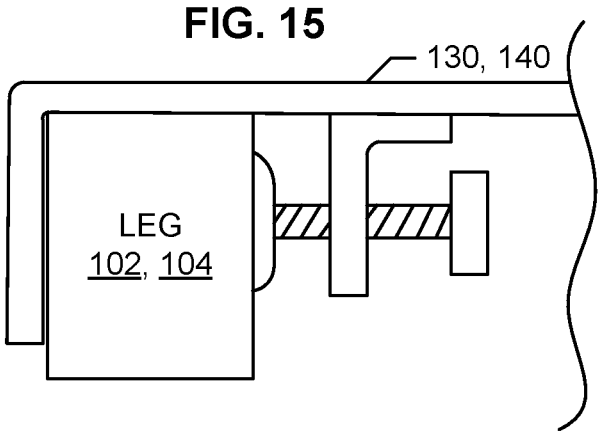
Figure 16:
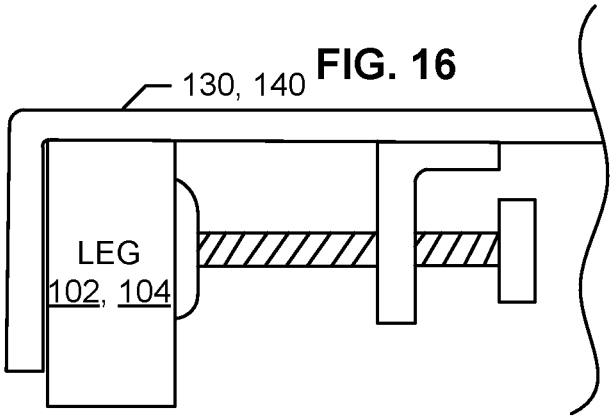

FIG. 15 shows an example top-down view of the stabilizer clamp portion 130 secured to a large size desk leg 102. The clamp 130, 140 is able to open far enough to fit larger desk legs such as this. FIG. 16 shows an example top-down view of the stabilizer clamp 130 secured to a small size desk leg 102. The clamp 130, 140 is able to close far enough to fit smaller desk legs such as this.

Figure 17:
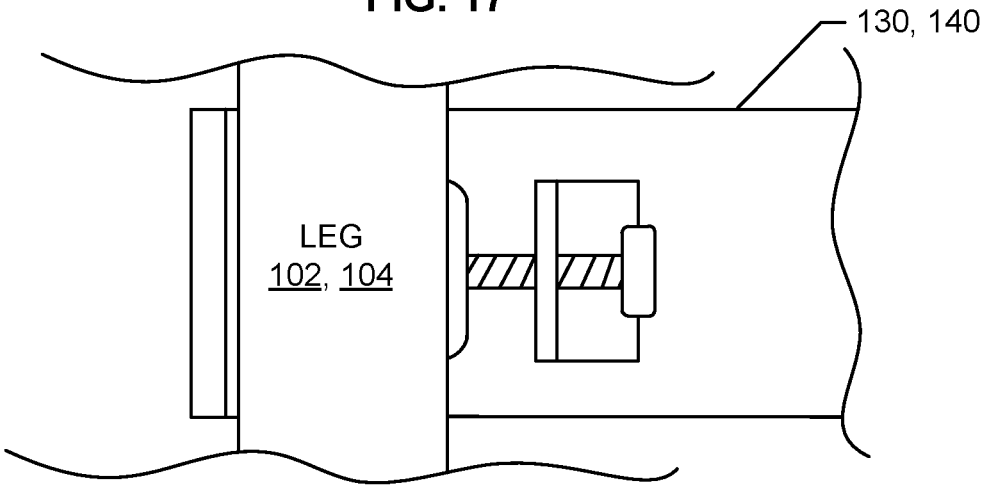
Figure 18:
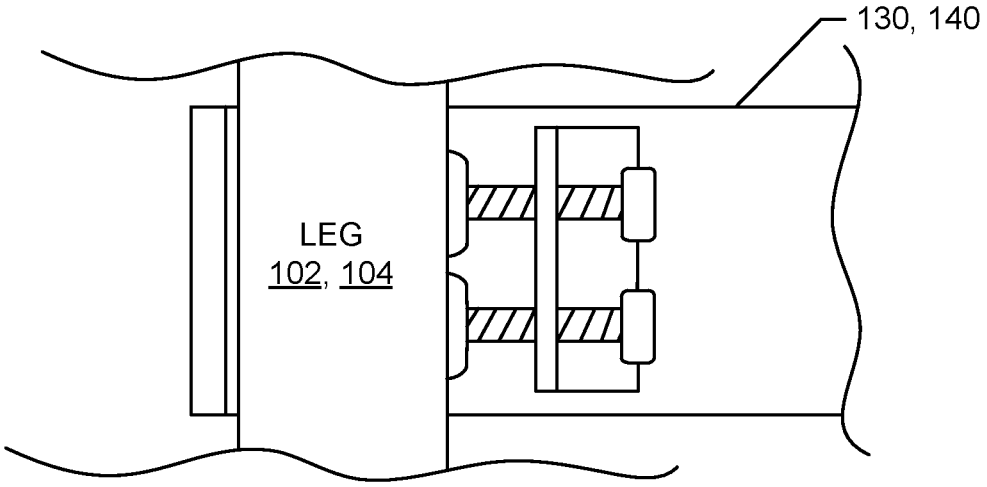

FIG. 17 shows an example front view of the stabilizer clamp 130, 140 secured to the desk leg 102, 104 using a single clamp bolt design. FIG. 18 shows an example front view of the stabilizer clamp 130, 140 secured to the desk leg 102, 104 using a multiple clamp bolt design.

Example Methods of Manufacture

Figure 19:
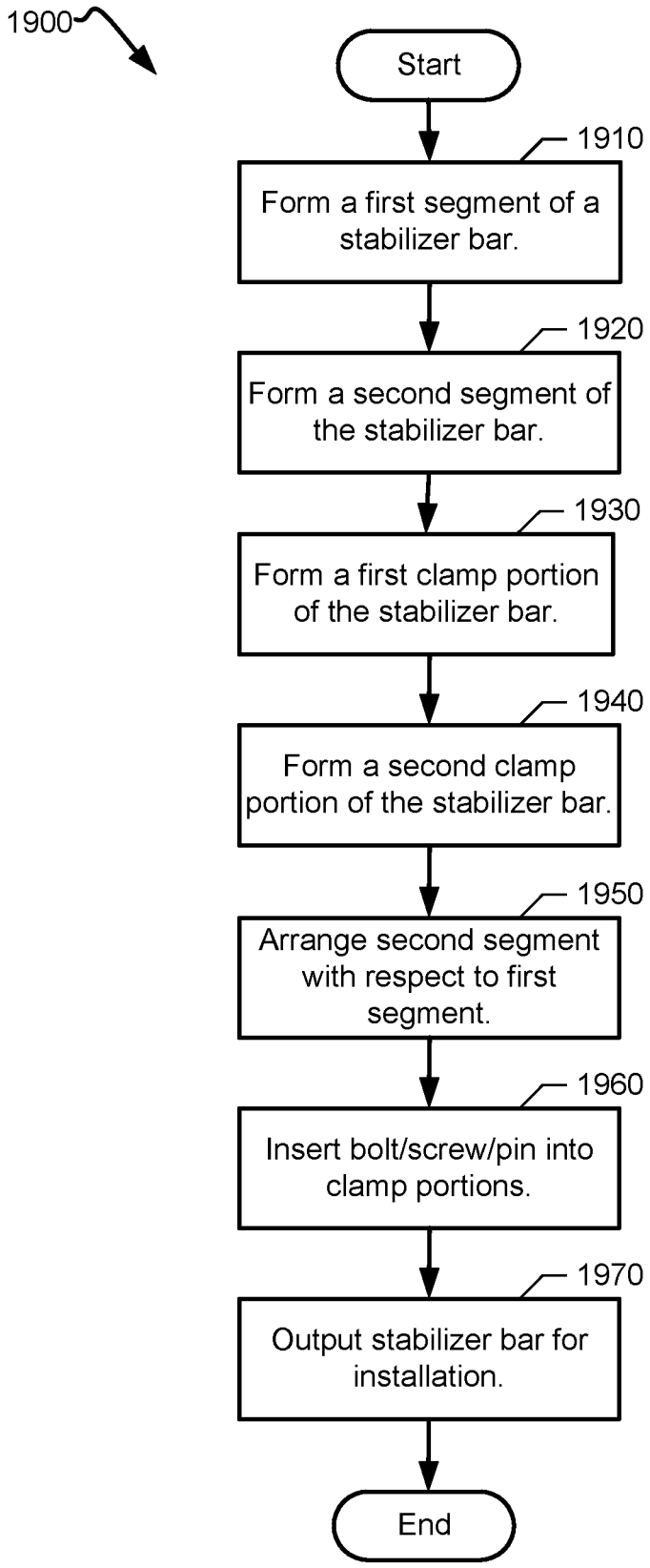
FIG. 19 illustrates a flow diagram of an example method of manufacturing and/or otherwise forming the stabilizer bar of FIGS. 1-18.

FIG. 19 illustrates a flow diagram of an example method of manufacturing and/or otherwise forming the stabilizer bar 100. The stabilizer bar 100 can be formed via one or more manufacturing processes such as mold casting, slush casting, sheet metal molding, CNC machining, turning, sand casting, investment casting, die casting, etc. While examples above discuss the stabilizer bar 100 as made of metal, in certain examples, the stabilizer bar 100 can be formed from plastic and/or other composite material formed form injection molding, thermoforming, rotomoting, CNC machining, etc.

At block 1910, the first segment 110 of the stabilizer bar 100 is formed. For example, a length, width, and depth of the segment 110 is defined, and holes/openings 112 are formed in the segment 110 to allow for adjustability of the segment 110 in the bar 100. The segment 110 can be formed from a rigid material (e.g., spring steel, mild steel, aluminum, etc.) sufficient to stabilize the leg 102 and support stress from leg 102 and/or associated desk/table motion, for example. In certain examples, the material (e.g., metal, composite, plastic, etc.) used to form the segment 110 can be treated, such as with paint, rust inhibitor, etc.

At block 1920, the second segment 120 of the stabilizer bar 100 is formed. For example, a length, width, and depth of the segment 120 is defined, and holes/openings 122 are formed in the segment 120 to allow for adjustability of the second segment 120 with respect to the first segment 110 to define a length of the stabilizer bar 100. The segment 120 can be formed from a rigid material (e.g., spring steel, mild steel, aluminum, etc.) sufficient to stabilize the leg 104 and support stress from leg 104 and/or associated desk/table motion, for example. In certain examples, the material (e.g., metal, composite, plastic, etc.) used to form the segment 120 can be treated, such as with paint, rust inhibitor, etc.

At block 1930, the first clamp portion 130 is formed such as through bending and/or fusing of metal segments to enable positioning and tightening of the stabilizer bar 100 with respect to the leg 102. Simultaneously or separately, at block 1940, the second clamp portion 140 is formed such as through bending and/or fusing of metal segments to enable positioning and tightening of the stabilizer bar 100 with respect to the leg 104.

At block 1950, the second segment 120 is arranged with respect to the first segment 110. For example, the second segment 120 can be slid and/or otherwise positioned over the first segment 110, or vice versa. The position of the second segment 120 with respect to the first segment 110 can be removably secured with one or more screws, bolts, etc., 132, 142. For example, the screws 132, 142 can be tightened but are able to be loosened and moved to another hole 112, 122, etc.

At block 1960, one or more bolts, screws, and/or pins 134, 136, 144, 146 are inserted in the clamp portions 130, 140. For example, the clamp portion 130, 140 can be formed at block 1930 such as shown in one or more of FIGS. 9-12, 16-18, etc. The bolt/screw/pin/etc. 134, 136, 144, 146 can be inserted to removably affix the clamp 130, 140 to the leg 102, 104 and enable adjustment (e.g., adjusting of the screw/bolt/pin/etc. 134, 136, 144, 146, etc.) to fine tune positioning and tightness of the stabilizer bar 100 with respect to the legs 102, 104, for example.

At block 1970, the stabilizer bar 100 is output for installation, other use, etc. For example, the stabilizer bar 100 can be packaged and sold, shipped, displayed, etc., for purchase, use, etc.

While a certain example method 1900 of manufacturing the stabilizer bar is disclosed and described above, one or more of the elements, processes and/or devices illustrated in FIG. 1900 can be combined, divided, re-arranged, omitted, eliminated and/or implemented in any other way.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc. may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, and (7) A with B and with C.

Thus, certain examples provide an adjustable stabilizer bar including: a first segment having a first end and a second end; a second segment having a first end and a second end, the first end of the second segment to at least partially overlap the second end of the first segment; an attachment mechanism to position the second segment with respect to the first segment; a first clamping portion at the first end of the first segment to removably affix the first segment to a first furniture element; and a second clamping portion at the second end of the second segment to removably affix the second segment to a second furniture element.

Certain examples provide a method of manufacturing an adjustable stabilizer bar. The example method includes forming a first segment having a first end and a second end. The example method includes forming a second segment having a first end and a second end, the first end of the second segment to at least partially overlap the second end of the first segment. The example method includes positioning the second segment with respect to the first segment with an attachment mechanism. The example method includes forming a first clamping portion at the first end of the first segment to removably affix the first segment to a first furniture element. The example method includes forming a second clamping portion at the second end of the second segment to removably affix the second segment to a second furniture element. The example method includes outputting the adjustable stabilizer bar.

Certain examples provide an adjustable stabilizer bar apparatus including: means for attaching a first segment with respect to a second segment; first means for clamping to a first furniture element; and second means for clamping to a second furniture element.

From the foregoing, it will be appreciated that example methods, apparatus and articles of manufacture have been disclosed that provide a new stabilizer bar that can be positioned to support a standing desk, height adjustable desk, height adjustable table, etc. The disclosed methods, apparatus and articles of manufacture improve existing standing/height-adjustable desks/tables by improving stability and increasing usability of a full range of height adjustment, enabling the desk/table to be stable when fully extended as well as when fully retracted. The disclosed apparatus, articles of manufacture, methods, etc., provide an adjustable stabilizer bar with both gross adjustment (e.g., positioning of multiple segments with respect to each other to define the length of the stabilizer bar, etc.) and fine adjustment (e.g., adjusting the clamp mechanism to help ensure secure, stable, fitted support by the bar between legs of a desk, table, etc.).

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. An adjustable stabilizer bar to restrict motion in furniture, the furniture having a first furniture element and a second furniture element, the first furniture element spaced apart from the second furniture element, the adjustable stabilizer bar comprising:

a first segment having a first end and a second end;

a second segment having a first end and a second end, the first end of the second segment to at least partially overlap the second end of the first segment;

an attachment mechanism extending through the first end of the first segment and through the second end of the second segment to adjustably lock the at least partially overlapped position of the second segment with respect to the first segment;

a first clamping portion at the first end of the first segment to removably affix the first segment to the first furniture element; and a second clamping portion at the second end of the second segment to removably affix the second segment to the second furniture element, wherein at least one of the first clamping portion or the second clamping portion is formed by attaching a U-shaped piece to at least one of the first end of the first segment or the second end of the second segment to interact with at least one bolt and a plate.

2. The adjustable stabilizer bar of claim 1, wherein the attachment mechanism includes openings through which at least one of a screw, bolt, or pin is inserted to position the second segment with respect to the first segment.

3. The adjustable stabilizer bar of claim 1, wherein the first clamping portion and the second clamping portion include at least one bolt.

4. The adjustable stabilizer bar of claim 3, wherein at least one of the first clamping portion or the second clamping portion includes a plurality of bolts.

5. The adjustable stabilizer bar of claim 1, wherein at least one of the first clamping portion or the second clamping portion is formed by bending the respective at least one of the first end of the first segment or the second end of the second segment to approximately ninety degrees to interact with at least one bolt and a plate.

6. The adjustable stabilizer bar of claim 1, wherein the first furniture element includes a first desk leg, and wherein the second furniture element includes a second desk leg.

7. The adjustable stabilizer bar of claim 1, wherein the second segment is to overlap the first segment by sliding over the first segment to be affixed in a position using at least one of a pin, a screw, or a bolt.

8. The adjustable stabilizer bar of claim 1, wherein the overlap of the second segment and the first segment is adjustable to adjust a length of the stabilizer bar, and wherein at least one of the first clamping portion or the second clamping portion is adjustable to secure the stabilizer bar between the first furniture element and the second furniture element.

9. The adjustable bar of claim 1, wherein at least one of the first segment or the second segment is formed of metal.

10. A method of manufacturing an adjustable stabilizer bar to restrict motion in furniture, the furniture having a first furniture element and a second furniture element, the first furniture element spaced apart from the second furniture element, the method comprising:

forming a first segment having a first end and a second end;

forming a second segment having a first end and a second end, the first end of the second segment to at least partially overlap the second end of the first segment;

positioning the second segment with respect to the first segment with an attachment mechanism, the attachment mechanism extending through the first end of the first segment and through the second end of the second segment to adjustably lock the at least partially overlapped position of the second segment with respect to the first segment;

forming a first clamping portion at the first end of the first segment to removably affix the first segment to the first furniture element; and forming a second clamping portion at the second end of the second segment to removably affix the second segment to the second furniture element.

11. The method of claim 10, wherein the attachment mechanism includes openings through which at least one of a screw, bolt, or pin is inserted to position the second segment with respect to the first segment.

12. The method of claim 10, wherein the first clamping portion and the second clamping portion include at least one bolt.

13. The method of claim 12, wherein at least one of the first clamping portion or the second clamping portion includes a plurality of bolts.

14. The method of claim 10, wherein at least one of forming the first clamping portion or forming the second clamping portion includes bending the respective at least one of the first end of the first segment or the second end of the second segment to approximately ninety degrees to interact with at least one bolt and a plate.

15. The method of claim 10, wherein at least one of forming the first clamping portion or forming the second clamping portion includes attaching a U-shaped piece to at least one of the first end of the first segment or the second end of the second segment to interact with at least one bolt and a plate.

16. The method of claim 10, wherein the first furniture element includes a first desk leg, and wherein the second furniture element includes a second desk leg.

17. The method of claim 10, wherein the second segment is to overlap the first segment by sliding over the first segment to be affixed in a position using at least one of a pin, a screw, or a bolt.

18. The method of claim 10, wherein the overlap of the second segment and the first segment is adjustable to adjust a length of the stabilizer bar, and wherein at least one of the first clamping portion or the second clamping portion is adjustable to secure the stabilizer bar between the first furniture element and the second furniture element.

* * * * *